United States Patent [19]

Yokota

[11] Patent Number: 4,965,498

[45] Date of Patent: Oct. 23, 1990

[54] ELECTRICALLY OPERATED SYSTEM FOR DRAWING CURTAINS AND OTHER TYPES OF BARRIERS

[75] Inventor: Takashi Yokota, Kanayawa, Japan

[73] Assignee: Kabushiki Kaisha Yokota, Tokyo, Japan

[21] Appl. No.: 370,044

[22] Filed: Jun. 22, 1989

[30] Foreign Application Priority Data

Nov. 10, 1988 [JP] Japan ..... 63-282390

[51] Int. Cl.[5] ..... A47H 5/00

[52] U.S. Cl. ..... 318/468; 318/15; 318/480; 160/331; 192/0.02 R

[58] Field of Search ..... 318/14, 15, 16, 264, 318/265, 266, 282, 286, 466, 467, 468, 470; 49/30, 25, 82, 84, 85; 160/7, 331; 192/0.02 R, 142 R

[56] References Cited

U.S. PATENT DOCUMENTS

| | | | |
|---|---|---|---|
| 4,234,833 | 11/1980 | Barrett | 318/282 |
| 4,364,003 | 12/1982 | Phipps | 318/467 |
| 4,471,274 | 9/1984 | Ross et al. | 318/282 |
| 4,564,791 | 1/1986 | Brickner | 318/16 |
| 4,612,485 | 9/1986 | Suska | 318/16 X |
| 4,775,039 | 10/1988 | Sunakawa | 192/142 R X |
| 4,819,708 | 4/1989 | Onosato et al. | 74/626 X |
| 4,827,199 | 5/1989 | Kaucic et al. | 160/331 X |

*Primary Examiner*—Bentsu Ro

*Attorney, Agent, or Firm*—Wenderoth, Lind and Ponack

[57] ABSTRACT

An electrically operated drawing system for drawing and undrawing curtains includes an electric motor, a clutch having a solenoid, a rotation detector for detecting rotation of the electric motor, an operating switch for outputting command signals, and a control logic circuit. The control logic circuit controls the rotation of the motor and the activation of the clutch. The clutch is used to operatively engaged the rotating motor with the curtains to thereby draw and undraw the curtains. The clutch includes a first spur gear drivable by the electric motor and a second spur gear operatively connected to the curtains. The clutch further includes an arm pivotally mounted to the second spur gear and a solenoid connected to the arm. A movement of the solenoid cause a movement of the arm to operatively engage the first and second spur gears.

4 Claims, 8 Drawing Sheets

ELECTRICALLY OPERATED SYSTEM FOR DRAWING CURTAINS AND OTHER TYPES OF BARRIERS

BACKGROUND OF THE INVENTION

1. Field of the Invention

The present invention relates to an electrically operated drawing system and, more particularly, to an electrically operated system for drawing curtains.

While the specification hereinafter generally relates to the drawing and undrawing of curtains, it is noted that the present invention is equally applicable to the drawing and undrawing of shades, drapes, covers, screens, blinds, accordion doors, and other types of barriers.

2. Statement of the Prior Art

The present inventor has previously proposed an electrically operated system for drawing curtains in Japanese Utility Model application No. 60-140669, now published as Japanese Laid-open application No. 62-51990. This application relates to an electrically operated drawing system designed to digitally detect an "off" signal at the time of completion of either the drawing or undrawing of a curtain to improve the responsiveness of the system, whereby both the inflow of surge currents into a logic circuit and the generation of noise are prevented, and whereby the malfunctions caused by external surge currents are avoided, thus resulting in improved reliability. However, that drawing system could not be changed over to a manual mode due to the absence of a clutch. In order to effect such a change-over to a manual mode, a clutch is required. Even with a device having an inexpensive mechanical clutch with a built-in solenoid, however, it is not possible to instantaneously effect a change-over of the operational mode due to the inertia of the solenoid mover.

The present inventor has also previously proposed an electrically operated system for drawing curtains in Japanese Utility Model application No. 61-89336, now published as Japanese Laid-open application No. 62-200982. This application relates to an electrically operated curtain drawing system which allowed for easy undrawing and drawing of a curtain whether in an electrically operational mode or in a manual mode and which was applicable to double curtains. In that electrically operated curtain drawer system, however, satisfactory gear-to-gear meshing was not always achieved and a jumping-over of the gears during operation was possible.

SUMMARY OF THE INVENTION

The first object of the present invention is to solve the aforesaid first problem of the Prior Art by providing an electrically operated drawing system having an inexpensive structure and a solenoid wherein, when undrawing or drawing curtain, a change-over of the operational mode can instantaneously be effected.

The second object of the present invention is to solve the aforesaid second problem of the Prior Art by providing an electrically operated curtain drawing system wherein, when undrawing or drawing a curtain, satisfactory gear-to-gear meshing is always assured without a jumping-over of the gears, whereby complete undrawing or drawing of the curtain is achieved.

According to the present invention, an electric motor is provided having a rotating shaft. A clutch is provided for engaging the rotating shaft with a driving pulley.

The driving pulley is used to draw and undraw the curtains when engaged with the rotating shaft. A rotation detector is provided for detecting the rotation of the rotating shaft and for outputting a rotation signal in accordance with the rotation of the rotating shaft. An operating switch is provided for outputting an operation command signal indicating the operational mode of the system. Additionally, a control means is provided for controlling the rotating shaft of the electric motor and the clutch in accordance with the rotation signal and the operational command signal.

The clutch includes a first spur gear rotatively mounted in the system and drivable by the electric motor and a second spur gear operably connected to the driving pulley. Additionally, an arm is provided pivotally mounted to the second spur gear and a solenoid is provided operatively connected to the arm. A movement of a solenoid causes a movement of the arm to operably engage and disengage the first spur gear and the second spur gear.

BRIEF DESCRIPTION OF THE DRAWINGS

The present invention will now be explained, by way of example, with reference to the accompanying drawings in which.

DETAILED EXPLANATION OF THE INVENTION

Figure 1:
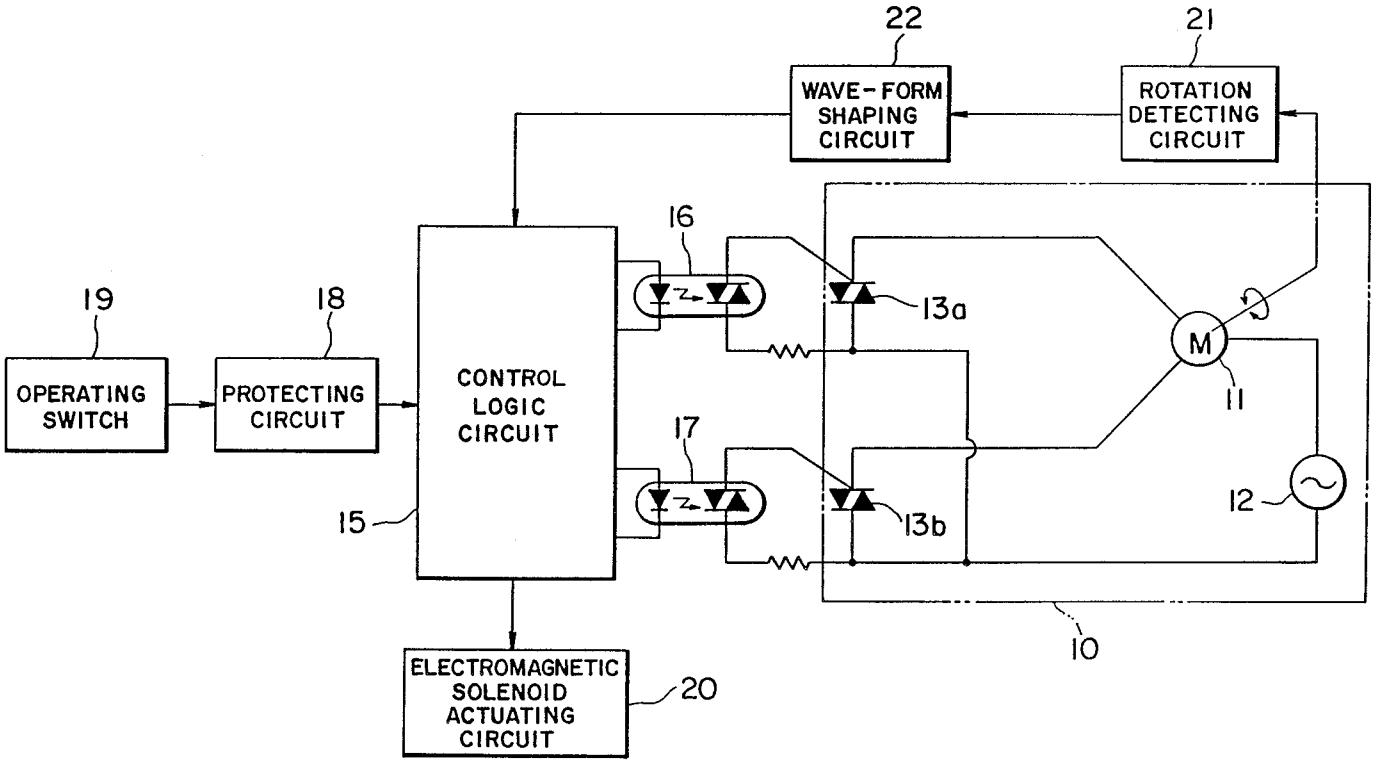
FIG. 1 is a block diagram of an embodiment of the electrically operated drawing system according to the present invention.
Figure 2:
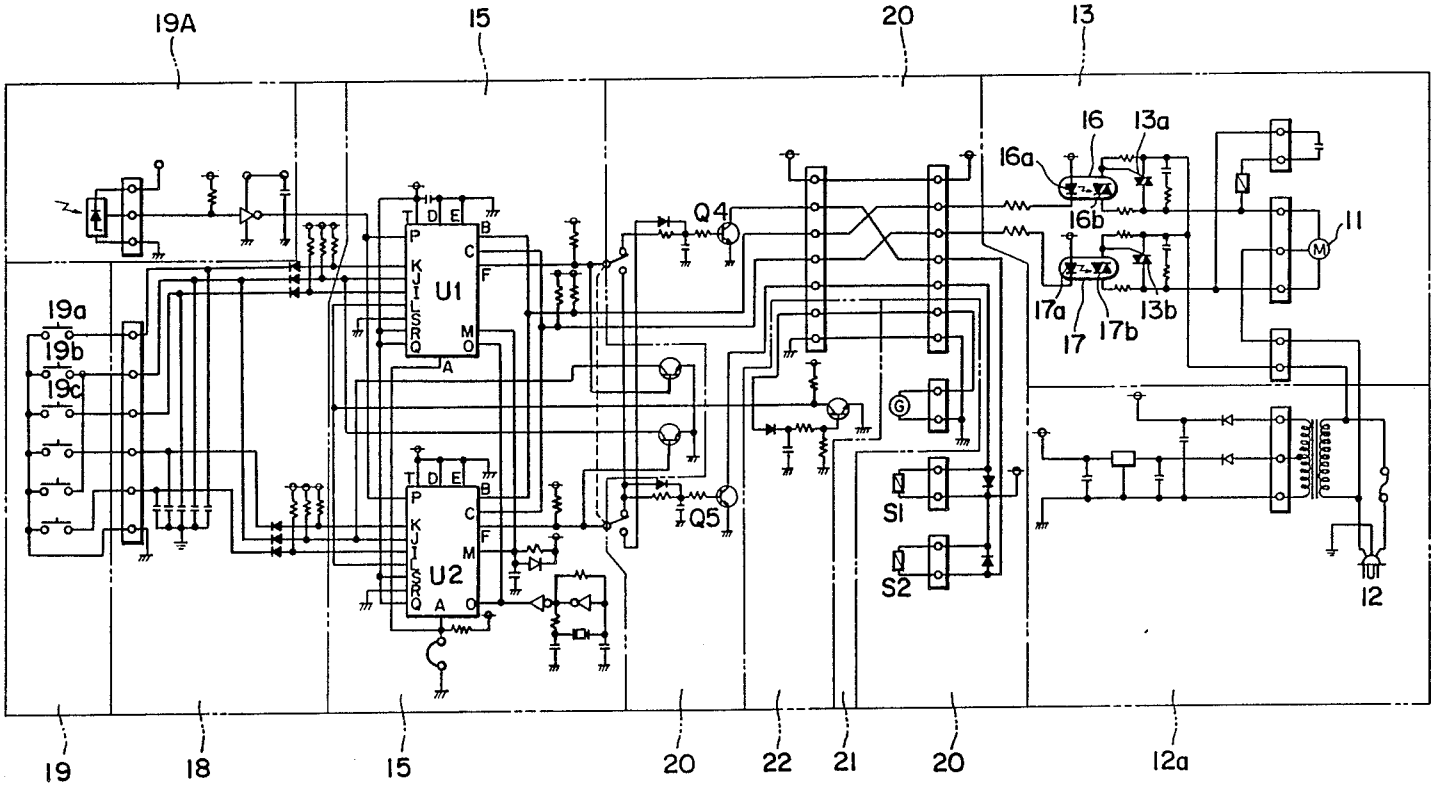
FIG. 2 is a circuit diagram of an embodiment of the present invention.

Referring first to FIGS. 1 and 2, reference numeral 10 denotes a main circuit; reference numeral 11 denotes an a.c. electric motor; reference numeral 12 denotes a power source; reference numerals **13*a* and 13*b* denote triacs functioning as a.c. control elements; reference numeral 15 denotes a control logic circuit; reference numerals 16 and 17 denote photo-triac couplers; reference numeral 18 denotes a protecting circuit; reference numeral 19 denotes an operating switch; reference numeral 19A denotes a remote-controlled input circuit; reference numeral 20 denotes an electromagnetic solenoid actuating circuit; reference numeral 21 denotes a tachometer (or rotation detecting) circuit, and 22** denotes a waveform shaping circuit.

The main circuit 10 is provided to drive the a.c. electric motor 11, and is defined by the circuit comprising the motor 11, the power source 12 and the triacs 13*a* and 13*b*.

The control logic circuit 15 controls the triacs 13*a* and 13*b* of the main circuit 10, which are connected to the control logic circuit 15 via the photo-triac couplers 16 and 17 defining an insulated input circuit.

The operating switch 19, which is connected to the control logic circuit 15 via the protecting circuit 18, sends an operation command signal to the control logic circuit 15. The operation command signal may be sent to the control logic circuit 15 by the remote-controlled input circuit 19A functioning as the operating switch 19.

The protecting circuit 18 includes diodes for preventing the entry of external surge currents into the control logic circuit 15 and for eliminating electrical influences exerted by fusing of, e.g., another electric motor connected to a connecting terminal of the operating switch 19, and for preventing generation of capacitive noises.

The tachometer circuit 21 digitally detects a voltage waveform change using a tacho-generator G to thereby detect the number of rotations of the a.c. electric motor 11 of the main circuit 100, and sends the resulting signal to the control logic circuit 15 via the waveform shaping circuit 22.

The electromagnetic solenoid energizing circuit 20 is also connected to the control logic circuit 15. When the operating switch 19*a* is engaged for normal operation or the operating switch 19*c* is engaged for reverse operation, the solenoid is energized, and when the operating switch 19*b* is engaged to stop the operation, the solenoid is deenergized.

Figure 3:
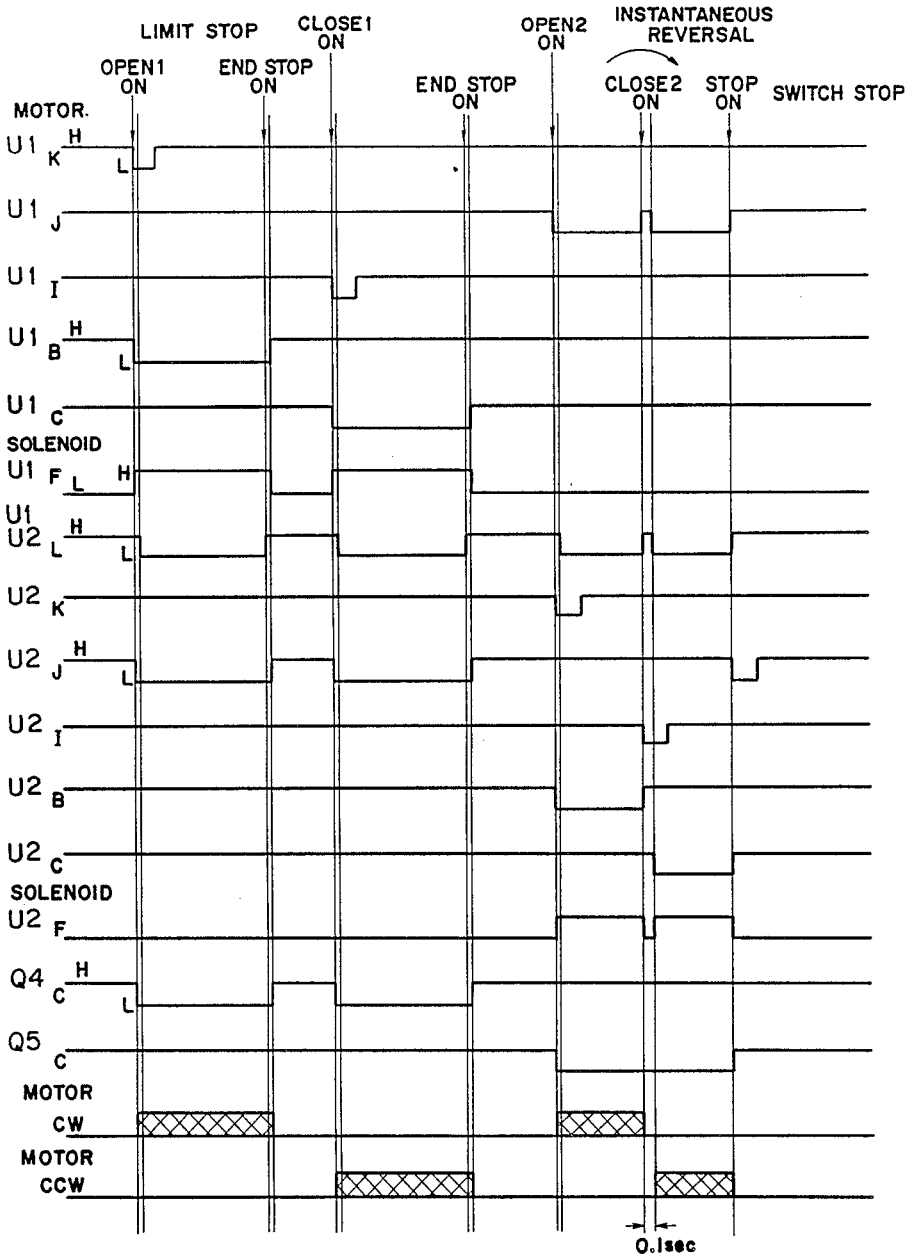
FIG. 3 is a timing chart illustrative of the operation of an embodiment of the present invention.
Figure 4:
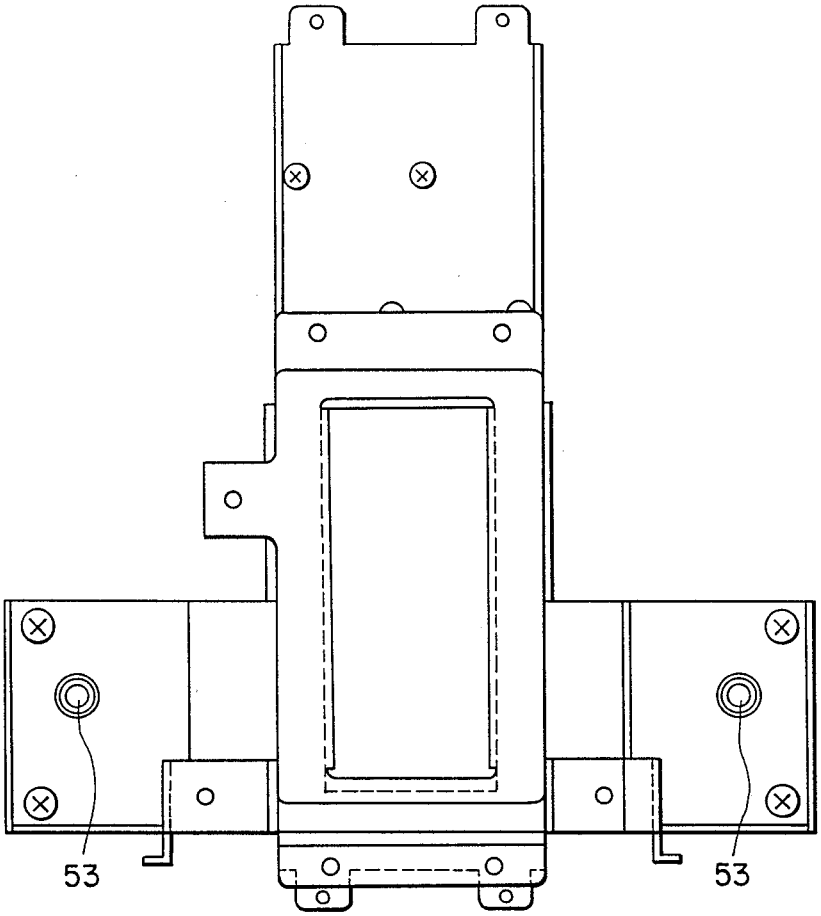
FIG. 4 is a front portion view of an embodiment of the electrically operated curtain drawing system according to the present invention.

The operation of the electrically operated curtain drawing system as constructed above will now be explained with reference to FIGS. 1 and 2, as well as FIG. 3.

Elements U1 and U2 as shown in FIG. 2 are respectively provided to control solenoids S1 and S2, an example of a circuit chip that may be provided as elements U1 and U2 is Model No. M50760-261P, manufactured by MITSUBISHI ELECTRIC CO., LTD. Since U1 and U2 operate in the same manner to respectively drive S1 and S2, the following description is only directed to the operation of U1 and S1, and the terminals described are those of S1.

First, when the operating switch 19*a* for undrawing the curtain is engaged, a signal L is input to a terminal K of U1 the control logic circuit 15 and output from a terminal B.

By this signal output from a terminal B, a diode 16*a* of the photo-triac coupler 16 emits light, causing triac 16*b* and triac 13*a* to conduct. Hence, the a.c. electric motor K is normally operated to undraw the curtain.

Figure 5:
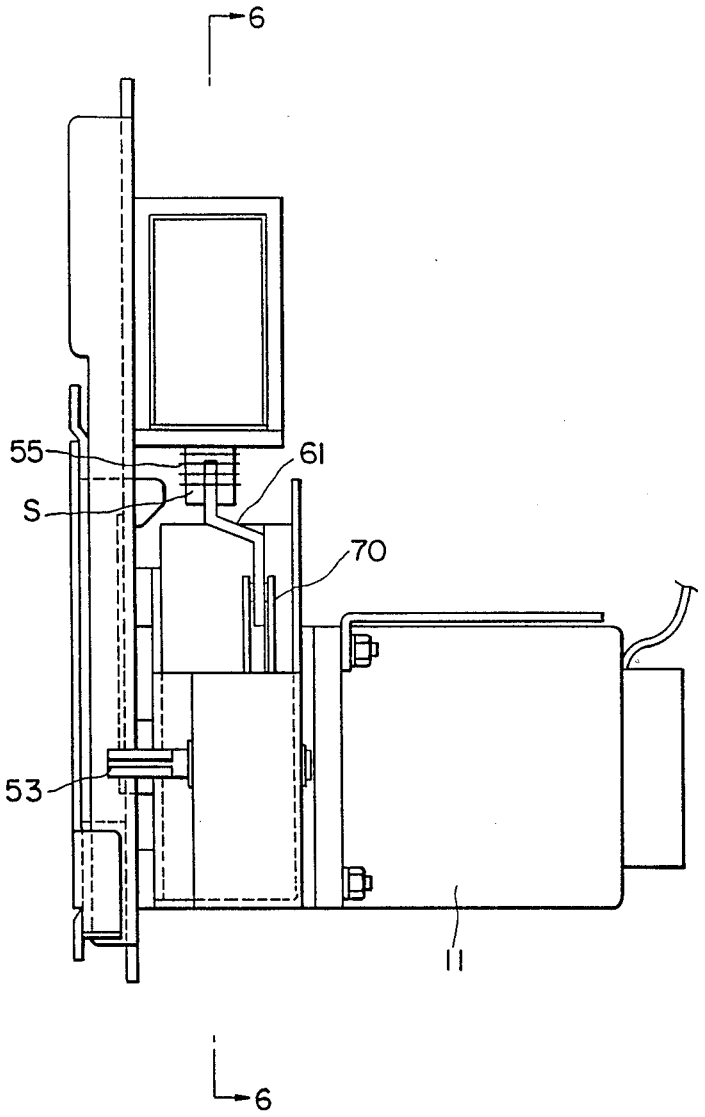
FIG. 5 is a right-hand side view of an embodiment of the present invention.
Figure 6:
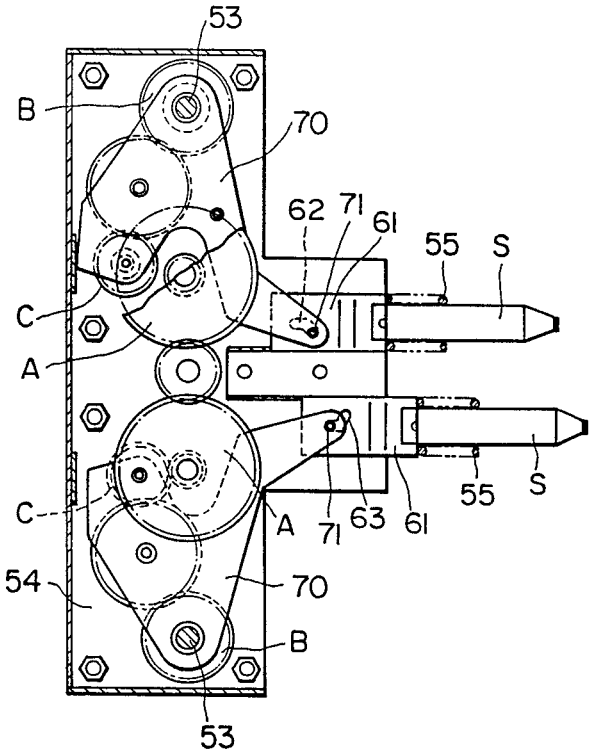
FIG. 6 is a cross-sectional view, taken along the line X–X of FIG. 5, of an embodiment of the present invention.
Figure 7:
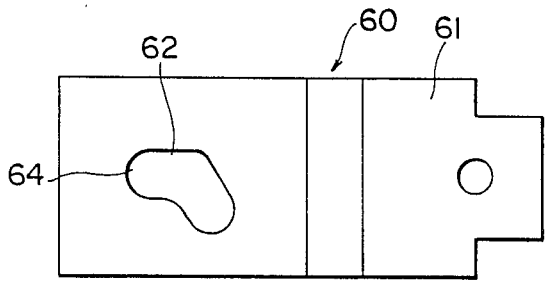
FIG. 7 is a front view of one cam plate of an embodiment of the present invention.
Figure 8:
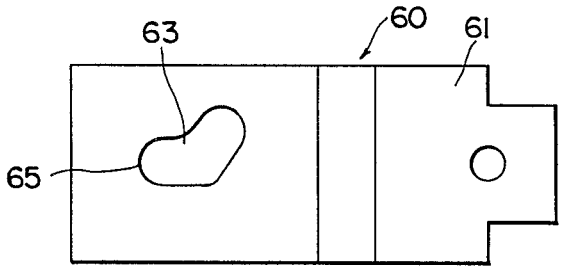
FIG. 8 is a front view of the other cam plate of an embodiment of the present invention.
Figure 9:
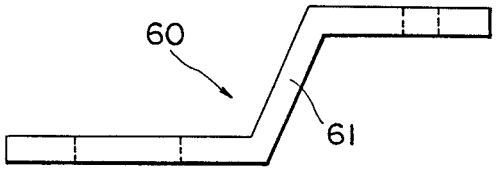
FIG. 9 is a front view of the cam plate of an embodiment of the present invention.

When the operating switch 19*a* is engaged to input the signal L to a terminal K of the control logic circuit 15, a signal H is output from a terminal F to cause the electromagnetic solenoid energizing circuit 20 to move the solenoids, as shown in FIGS. 5 and 6, so that a spur gear A of the drawing system meshes with a spur gear C thereof and a driving force of the a.c. electric motor 11 rotates a shaft 53 of a spur gear B joined to a curtain driving pulley 52 (see FIG. 10) to undraw (i.e.-close) the curtain. It is noted that the remote-controlled input circuit 19A may be operated in place of the manual manipulation of the operating switch 19*a*.

When the curtain is fully undrawn or drawn, a voltage waveform change is digitally picked up and detected by the tacho-generator G, and the resulting signal is sent to the control logic circuit 15 through the waveform shaping circuit 22 to stop the operation of a.c. electric motor 11.

When the operating switch 19*c* is engaged for drawing the curtain, a signal L is input to a terminal I of the control logic circuit 15, and a signal L is then output from a terminal C. By this signal output from a terminal C , a diode 17*a* of the photo-triac coupler 17 emits light causing the triac 17*b* and the triac 13*b* to conduct. Hence, the a.c. electric motor 11 is reversed to thereby draw the curtain.

Additionally, when the operating switch 19*c* is engaged to input the signal L to the terminal I of the control logic circuit 15, a signal H is output from the terminal F causing the electromagnetic solenoid energizing circuit 20 to energize and move the solenoids. As a result, the spur gear A of the curtain drawing system meshes with the spur gear C thereof, so that the driving force of the a.c. electric motor 11 rotates the shaft 53 of the spur gear B joined to the curtain driving pulley 52 through a gear to thereby draw the curtain.

To stop the curtain during an undrawing or drawing operation, the operating switch 19*b* is activated to stop the a.c. electric motor 11. When the operating switch 19*b* is activated, a signal L is input to a terminal J of the control logic circuit 15, so that a signal H is output from the terminals B and C and a signal L is output from the terminal F. By the signal H output from the terminals B and C, the emission of light from the diodes 16*a* and 17*a* of the photo-triac couplers 16 and 17 is stopped and the conduction of the triacs 16*b* and 17*b* and 13*a* and 13*b* is stopped, so that the a.c. electric motor 11 is stopped. The signal L output from the terminal F causes the electromagnetic solenoid energizing circuit 20 to move the solenoid so that the spur gear A of the curtain drawing system is disengaged from the spur gear C thereof to thereby stop the movement of the curtain.

When the movement of the curtain is reversed during an undrawing or drawing operation, for example, when the operation switch 19*c* is activated while the curtain is being drawn by initially engaging operating switch 19*a*, such a reversal is instantaneously achieved with the system disclosed in Japanese Utility Model Publication No. 62-51990, since it is of the type that includes no electromagnetic clutch. However, that system cannot be applied to this embodiment which is designed to undraw and draw the curtain using an electromagnetic clutch.

In the instant embodiment, since the electromagnetic solenoid energizing circuit 20 is provided, such a reversal operation is achieved almost the moment the operating switch 19*c* for drawing is engaged while the curtain is being undrawn by initially engaging the operating switch 19*a*. When the operating switch 19*c* is activated, a signal L is input to the terminal I of the control logic circuit 15, and a signal L is output from the terminal C, as already mentioned. However, the changeover from the terminal B, to the terminal C takes place within an interval of about 0.1 second. Hence, the a.c. electric motor 11 is reversed within an interval of about 0.1 second. When the operating switch 19*c* is engaged to input a signal L to the terminal I of the control logic circuit 15, a signal H is similarly output from the terminal F in an interval of about 0.1 second. Hence, since a spring 55 is contracted without giving any time for the disengagement of the spur gear A from the spur gear C, the solenoid S is operated while the spur gear A is engaged with the spur gear C, so that the curtain is drawn. The same also holds when the operating switch 19*a* for undrawing is engaged while the curtain is being drawn by initially engaging the operating switch 19*c*.

Another aspect of the present invention will now be explained with reference to FIGS. 4 through 10. This aspect of the present invention relates to the electrically operated drawing system according to the present invention, wherein complete undrawing or drawing of a curtain is achieved by providing gears which mesh well with each other to prevent their jumping-over.

In the aforementioned Figures, A, B and C denote spur gears; S denotes a solenoid; reference numeral 11*a* denotes an electric motor; reference numeral 51 denotes a gear; reference numeral 52 denotes a curtain driving pulley; reference numeral 53 denotes a shaft; reference numeral 54 denotes a frame; reference numeral 55 denotes a spring; reference numeral 60 denotes a connector; reference numeral 61 denotes a cam plate; reference numerals 62 and 63 denote cam holes; reference numeral 70 denotes an arm; and reference numeral 71 denotes a shaft.

The electric motor 11*a* may be of either the alternating current or direct current type.

The spur gear A is engaged with and driven by the gear 51 which is driven by the electric motor 11*a*.

On the other hand, the spur gear B is integrally connected to a shaft of the curtain driving pulley 52. Both the spur gears A and B are journaled on the frame 54.

The arm 70 is rotably supported at one end on the shaft 53 of the spur gear B and connected at the other end with the solenoid S through the connector 60 which is displaceable by the energization of the solenoid S.

Figure 10:
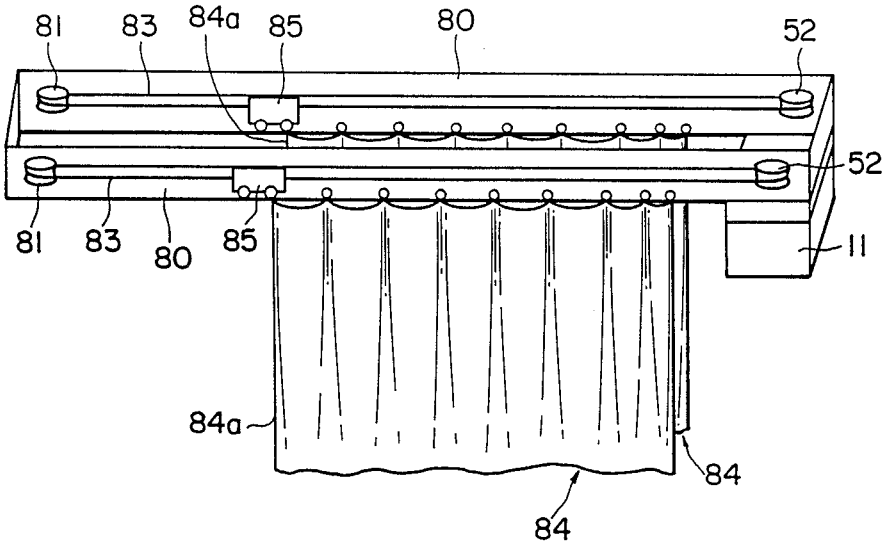
FIG. 10 is a view illustrative of the drawing mechanism used for double curtains according to the present invention.

Referring to FIG. 10, the curtain driving pulley 52 driven by the electric motor 11*a* is attached to one end of a curtain rail 80, which is provided at the other end with a single-wheel pulley 81. An endless wire 83 is provided between and around the pulley 52 and 81. At a predetermined position of the endless wire 83, there is joined a leading curtain runner 85 to which a drawing edge 84*a* of a curtain 84 is locked. The endless wire 83 is moved by actuating or stopping the electric motor 11*a* by the operating switch 19 to move or stop the leading curtain runner 85, thereby undrawing or drawing the curtain 84. In this case, both and/or one of the double curtains may freely be undrawn or drawn by the manipulation of the operating switch 19.

Next, the mechanism for undrawing or drawing the curtain 84 will be explained. In the instant embodiment, the connector 60 is defined by the cam plate 61, which is journaled on one end of the solenoid S. The arm 70 has one end shaft 71 loosely fitted into the cam holes 62 and 63. In the instant embodiment, both the cam holes 62 and 63 are formed as illustrated. However, they are not limited to such a form, and may take on an arched form which may or may not have one end extended. Complete undrawing or drawing of the curtain is achieved by the provision of the cam plate 61, since satisfactory gear-to-gear meshing is assured without jumping-over. In particular, the extensions, shown at 64 and 65, of the ends of the arched cam holes 62 and 63 assure a more satisfactory gear-to-gear meshing, so that the prevention of jumping-over can more certainly be achieved.

The connector 60 is not limited to a toggle using the cam plate 61. For instance, it may take on a rod-like or plate-like form and be journaled on one end of the solenoid S and the arm 70. In this case, satisfactory gear-to-gear meshing is similarly achieved without jumping-over.

The spur gear C is journaled on the arm 70, and is designed in such a manner that it engages or disengages the spur gear A. When the solenoid S is energized, the arm is pushed left by the biasing force of the spring 55, as illustrated in the upper portion of FIG. 5, so that the spur gear C disengages the spur gear A. When the solenoid S is deenergized, the arm is pulled right against the biasing force of the spring 55, as illustrated in the lower portion of FIG. 5, so that the spur gear C engages the spur gear A.

The electrically operated curtain drawing system according to the present invention is constructed as above. Thus, as the operating switch 19 is engaged to actuate the electric motor 11*a*, the solenoid S is deenergized so that the arm is pulled against the biasing force of the spring 55 for the engagement of the spur gear C with the spur gear A. Hence, the spur gear A, spur gear C, spur gear B and curtain driving pulley 52 are all rotated by the electric motor 11 a to undraw or draw the curtain.

When the operating switch 19 is disengaged to stop the electric motor 11*a*, undrawing or drawing of the curtain is stopped, while the solenoid S is so energized that the arm is pulled left in the upper portion of FIG. 5 by the biasing force of the spring 55 for the disengagement of the spur gear C from the spur gear A. Hence, the curtain can be easily undrawn or drawn in a manual mode, since the spur gears B and C rotate, but the electric motor 11*a* does not due to the disconnection of the motor 11*a* from the cooperative spur gear A.

While the instant embodiment has been described with reference to an electrically operated curtain drawing system used with double curtains, the electrically operated curtain drawing system according to the present invention is also applicable to a single curtain.

Constructed as above, the present invention has the following advantages:

According to the electrically operated drawing system of the present invention, a change-over of the operational mode can instantaneously be effected with an inexpensive structure using a solenoid, when undrawing or drawing double curtains.

According to the electrically operated curtain drawing system of the present invention, satisfactory gear-to-gear meshing is assured without jumping-out when undrawing or drawing a curtain, whereby complete undrawing or drawing of the curtain is achieved.

What is claimed:

1. An electrically operated drawing system for drawing and undrawing a barrier, said system comprising:

an electric motor having a rotating shaft mounted to a drive gear;

a clutch means for operatively engaging said rotating shaft with a driving pulley, said driving pulley for undrawing and drawing the barrier when operatively engaged with said rotating shaft, said clutch means comprising a first spur gear, a second spur gear, a third spur gear, a solenoid, an arm, a spring, a connector, and an electromagnetic solenoid energizing circuit, said first spur gear engageable with said drive gear and drivable by said electric motor, said second spur gear integrally connected to a shaft of said driving pulley, said third spur gear rotatably mounted to said arm and operatively engageable with said first spur gear, said solenoid operatively connected at one end thereof to said arm through said connector, said arm rotatably supported at one end thereof by said second spur gear and having a shaft loosely fitting into a cam hole of said connector at another end thereof, said spring being mounted between said connector and said solenoid for disengaging said first spur gear and said third spur gear by pulling said solenoid and pushing said arm through said connector when said solenoid is energized, said connector having a cam aperture formed therein and operatively disposed between said arm and said solenoid, and said electromagnetic solenoid energizing circuit for controlling the movement of said solenoid for operatively engaging and disengaging said first spur gear and said third spur gear by moving said arm through said connector in accordance with the movement of said solenoid;

an operating switch means for outputting an operational command signal, said operational command signal indicating an operational mode of the system;

a control means coupled to said electric motor, said clutch means, and said operating switch means, said control means for controlling said rotating shaft of said electric motor and said clutch means in accordance with said operational command signal.

2. The electrically operated drawing system as claimed in claim 1, further comprising photo-couplers connected between said electric motor and said control means.

3. The electrically operated drawing system according to claim 1, wherein said operating switching means comprises a manual switch and a remote control switch.

4. The electrically operated drawing system according to claim 1, further comprising a rotation detection means coupled to said electric motor and said control means, said rotation detection means for detecting a rotation of said rotating shaft and for outputting a signal to said control means in accordance with said rotation.

* * * * *